US007427192B2

(12) United States Patent
Lamparski et al.

(10) Patent No.: US 7,427,192 B2
(45) Date of Patent: Sep. 23, 2008

(54) TOOTHING OF A TOOTHED WHEEL

(75) Inventors: Christof Lamparski, Mittelbiberach (DE); Sven Peters, Eberhardzell (DE)

(73) Assignee: Schwabische Huttenwerke GmbH, Aalen-Wasseralfingen (DE)

( * ) Notice: Subject to any disclaimer, the term of this patent is extended or adjusted under 35 U.S.C. 154(b) by 0 days.

(21) Appl. No.: 10/375,590

(22) Filed: Feb. 27, 2003

(65) Prior Publication Data

US 2004/0009085 A1 Jan. 15, 2004

(30) Foreign Application Priority Data

Feb. 27, 2002 (DE) ..... 102 08 408

(51) Int. Cl.
*F03C 4/00* (2006.01)
*F04C 18/00* (2006.01)

(52) U.S. Cl. ..... 418/171

(58) Field of Classification Search ..... 418/171, 418/166, 164, 201.3, 206.5; 74/462
See application file for complete search history.

(56) References Cited

U.S. PATENT DOCUMENTS

| | | | | |
|---|---|---|---|---|
| 1,682,563 A | | 1/1928 | Hill | |
| 1,833,993 A | | 12/1931 | Hill | |
| 2,031,888 A | | 2/1936 | Hill | |
| 2,091,317 A | * | 8/1937 | Hill | 74/462 |
| 2,389,728 A | | 11/1945 | Hill | |
| 2,960,884 A | | 11/1960 | Hill, II | |
| 3,709,055 A | | 1/1973 | Grove | |
| 3,881,364 A | * | 5/1975 | Rouverol | 74/462 |
| 4,106,361 A | * | 8/1978 | Burtis | 74/462 |
| 4,112,782 A | | 9/1978 | Mullins | |
| 4,276,785 A | * | 7/1981 | Rouverol | 74/462 |
| 5,368,455 A | | 11/1994 | Eisenmann | |
| 6,244,843 B1 | | 6/2001 | Kosuge | |

FOREIGN PATENT DOCUMENTS

| | | |
|---|---|---|
| EP | 0 552 443 | 7/1993 |
| EP | 1 016 784 | 7/2000 |
| JP | 10-205458 | 8/1998 |

* cited by examiner

*Primary Examiner*—Theresa Trieu
(74) *Attorney, Agent, or Firm*—RatnerPrestia

(57) ABSTRACT

A toothing of a toothed wheel, consisting of tooth tips and tooth roots of teeth which are formed by second or higher order curves, wherein said curves point tangentially toward each other at their ends, and wherein at least the curves forming the tooth tips or at least the curves forming the tooth roots are not cycloids.

36 Claims, 6 Drawing Sheets

TOOTHING OF A TOOTHED WHEEL

The invention relates to a toothing of a toothed wheel, furthermore to a gear-type running carriage formed using the toothed wheel and lastly to a gear-type machine formed using the toothed wheel running carriage. The gear-type machine, which is preferably a ring gear machine with an internal axle, can be a motor or preferably a positive displacement pump.

Ring gear pumps are known having a toothed wheel running carriage consisting of an externally toothed internal rotor and an internally toothed external rotor which are in a mating toothed mesh with each other. The toothings of the two rotors form circulating, expanding and contracting delivery cells for a working fluid. The toothings which mate with each other to form the delivery cells comprise tips and roots of the teeth formed by epicycloids and/or hypocycloids or epitrochoids and/or hypotrochoids. If for example one of the two toothings in toothed mesh is alternately formed by epicycloids and hypocycloids, then a companion toothing generated by kinematic derivation in accordance with the law of toothings likewise emerges as a toothing consisting of alternately meeting epicycloids and hypocycloids. In practice, however, the two theoretical tooth profiles thus obtained cannot roll off onto each other and would, due to the complete overlap of the base of the tooth root and the crown of the tooth tip in the area of maximum toothed mesh, cause insurmountable noise problems due to squeeze oil effects.

In order to solve the noise problem, U.S. Pat. No. 6,244,843 B1 proposes shaping each of the mutually mating toothings of the internal rotor and the external rotor as cycloid toothings comprising complete epicycloids and hypocycloids, but generating the epicycloids of the toothing of the internal rotor with smaller pitch circles than the epicycloids of the external rotor, and the hypocycloids of the toothing of the external rotor with smaller pitch circles than the hypocycloids of the toothing of the internal rotor. This, however increases the flank backlash in the same way it creates space for the squeeze oil. Noises are at best reduced at the cost of volumetric efficiency.

A ring gear pump proven in practice is described for example in U.S. Pat. No. 5,368,455. In order to minimise the in principle inevitable backlash between the toothings, the tips of the teeth of the internal rotor and the tips of the teeth of the external rotor, and possibly the roots of the teeth of the other rotor in each case which co-operate with the tips of the teeth, are levelled off toward the pitch circle of the rotor in question. The mutually mating toothings are formed as cycloid toothings, although for the purpose of levelling off they are formed as truncated epicycloids and hypocycloids. Since, as they are truncated, the epicycloids and hypocycloids at the reference circle no longer seamlessly meet, the transitions are bridged by linear pieces. At the transition points, however, discontinuities arise which for their part cause noise problems. Furthermore, the crimp spaces are still not ideal.

SUMMARY OF THE INVENTION

It is an object of the invention to provide a toothed wheel which, in a preferred application as a-feed wheel of a gear-type pump or a driven wheel of a gear-type motor, helps to reduce noises when the pump or motor is operated.

In accordance with a first aspect of the invention, a toothed wheel comprises a toothing whose meeting tips and roots of the teeth are formed by second or higher order curves which point tangentially toward each other at their ends. This means that the tooth profile at the transition points between the curves forming the tooth tips and the curves forming the tooth roots are not only continuous but can also be differentiated. Preferably, the contour of the profile of the toothing can be differentiated continuously all over. Furthermore, at least the curves forming the tooth tips or at least the curves forming the tooth roots are not cycloids, wherein the term cycloid in the sense of the invention is also to be understood to mean a truncated or elongated cycloid. The contour of the profile of the tooth tips and/or the tooth roots not being cycloid means that the curves in question are not based on rolling off rolling circles on a fixed circle, without sliding, for example by initially being shaped as cycloids and then machined with an offset, in order to obtain a required backlash.

The toothing preferably comprises at least four teeth. It preferably extends over the entire internal or external circumference of the toothed wheel.

Although less preferred, it is in principle conceivable to form the toothing in accordance with the invention such that its tooth tips are formed by cycloids and its tooth roots are each formed by an at least second order curve, preferably a curved arc of a conic section, in particular a circular arc or elliptical arc or an arc of a near-elliptical curve, which points tangentially toward the adjacent cycloid arcs at its ends, such that no kinks arise at the transitions. The tooth tips of the companion toothing can preferably likewise be formed by cycloids and the tooth roots each by an at least second order curve. Advantageous squeeze oil spaces would be formed between the curves and the meshing cycloids of the two toothings. As described by way of example in this embodiment, in a toothing formed from cycloids and non-cycloids, the tooth roots are preferably formed by second or higher order, non-cycloid curves. In principle, however, the tips may be formed by second or higher order, non-cycloid curves and the roots by cycloids.

In preferred embodiments, both the tooth tips and the tooth roots are not formed by cycloids, neither epicycloids and hypocycloids nor truncated or elongated epicycloids or hypocycloids. Particularly preferably, the tooth tips and the tooth roots are also not formed by other curves which are generated with the aid of rolling circles which roll off without sliding on the reference or pitch circle of the toothed wheel. In preferred embodiments, the contour of the profile of the tooth tips is a conic section arc. Even more preferably, the contour of the profile of each of the tooth roots is also a curved arc of a conic section, i.e. a circular arc, an elliptical arc, a hyperbolic arc or a parabolic arc. Another preferred example are higher order, near-elliptical curves, for example a Cassini curve in its near-elliptical shape, which can also form the contour of the profile of the tooth tips and/or the tooth roots. If an ellipse or a near-elliptical curve forms the contour of the profile, then the ratio of the length of the large main axis to the length of the small main axis is preferably at least 1:1 and preferably at most 2. A length ratio in the range 1.25 to 1.6 is particularly preferred.

Advantageously, the contour of the profile of each of the tooth tips is formed by a curved arc of a first shape and the contour of the profile of each of the tooth roots by a curved arc of another, second shape. In this way, the tooth tips and the tooth roots can for example each be formed by elliptical arcs, wherein however the curved arcs of the tooth tips are taken from a different ellipse than the curved arcs of the tooth roots. Even more preferably, each arc of a curve of a first type forms the tooth tips, preferably an elliptical arc or an arc of a near-elliptical curve in each case, and each arc of a curve of another type forms the tooth roots, preferably a circular arc in each case. The same curved arcs are of course used for each of the tooth tips of the toothing and the same curved arcs for each of the tooth roots of the toothing.

In accordance with a second aspect of the invention, a toothed wheel comprises a toothing the meeting tooth tips and tooth roots of which are formed by second or higher order curves which point tangentially toward each other at their ends, wherein at least the curves forming the flanks of the tooth tips are formed by arcs of an ellipse, the two main axes of which are unequal, or by arcs of an ellipse-like curve, this curve preferably being a Cassini curve in its ellipse-like form. Although the crowns of the tips may, in principal, be flattened and/or the tip flanks be connected to the tooth roots by small linear pieces, it is preferred that said elliptic or near-elliptic arcs form not only the flanks of the tooth tips but also their crowns as a single continuous arc of an ellipse or an ellipse-like curve up to the two meeting points with the neighbouring tooth roots. As far as features are described in the specification or by the claims with respect to the first aspect of the invention the toothing according to the second aspect of the invention my advantageously exhibit those features as long as those features are not in direct contradiction to the second aspect of the invention. Most preferred the toothed wheel is a wheel in accordance with both aspects.

In particular, the tooth tips and the tooth roots can exhibit different thicknesses, when measured on the reference or pitch circle of the toothed wheel wherein delivery flow pulsations can be reduced using tooth tips of the toothed wheel in accordance with the invention which are broad in comparison with the tooth roots, but also using tooth tips which are narrow in comparison with the tooth roots, as has already been described in EP 0 552 443 B1 and EP 1 016 784 A1 for other profiles. On the other hand, delivery flow pulsations are already reduced, as compared with known solutions, by forming the toothing in accordance with the invention, such that even a toothing consisting of tooth tips which are equally thick is already advantageous.

The curves forming the tooth tips or tip flanks preferably directly meet the curves forming the tooth roots, such that the tooth profile exhibits a finite curvature all over. Although less preferred, it is however also possible in principle for the two curves to be connected by linear pieces. However, in such an embodiment of the toothing, each connecting straight line would have to tangentially elongate the curves connected to the two linear ends, i.e. would have to tangentially approach said two curves. A profile which is curved all over is, however, more favourable for the sliding movement of the flanks of the teeth.

The curved arcs of the tooth tips and the curved arcs of the tooth roots preferably meet on the reference circle of the toothed wheel and are preferably adapted osculatingly to each other there. It is, however, also possible to shift the meeting points between the curves of the tooth tips and the curves of the tooth roots slightly outwards or inwards away from the reference circle, and not only in the less preferred embodiment in which the ends of the curves are connected to each other by linear pieces, but also in the preferred embodiment in which they directly meet.

The invention further relates to a toothed wheel running carriage which consists of at least two toothed wheels which are or may be brought into toothed mesh, in order to roll off on each other. At least one of the toothed wheels comprises a toothing of the type in accordance with the invention.

The companion toothing of the other toothed wheel of the at least two toothed wheels is derived over its entire profile, or in a preferred embodiment only the profile of its tooth roots, kinematically from the toothing in accordance with the invention, in accordance with the law of toothings. If the toothed wheel running carriage forms feed wheels of a ring gear pump or driven wheels of a ring gear motor, then a continuous rolling off and sliding off of the flanks of the teeth, and sufficient squeeze spaces for the working fluid, are obtained between the toothing in accordance with the invention and the companion toothing formed in this way, due to the difference in the number of teeth on the two meshing toothings. At a simultaneously high volumetric efficiency, noise development by the toothed wheel running carriage is therefore reduced.

In a particularly preferred embodiment, only the profile of the tooth roots of the companion toothing is kinematically derived from the toothing in accordance with the invention, in accordance with the law of toothings, while the profile of the tooth tips of the companion toothing is obtained from enveloping intersections of the profile of the tooth tips of the toothing in accordance with the invention. The curve of the tooth tips of the companion toothing is the connecting line of points on curves of the tooth tips of the toothing in accordance with the invention. The curve of the tooth tips of the companion toothing envelopes the curves of the tooth tips of the toothing in accordance with the invention which tips are rotated onto the corresponding tooth tip of the companion toothing. The connecting line of these points, forming the profile of the tooth tips of the companion toothing, can in particular be a spline function.

Since on the one hand, the hollow spaces formed in this way between the tooth roots of the toothing in accordance with the invention and the tooth tips of the companion toothing provide advantageous space for squeeze fluid, but on the other hand a dead volume of working fluid is being transported in circulation, it can be advantageous to level off the profile of the tooth roots of the toothing in accordance with the invention, i.e. to bring in the tooth roots, in their respective crown or apex area, closer to the reference circle of the toothed wheel. This causes a deviation, for example from the exact circular arc shape or the otherwise selected curve of the tooth roots, which is preferably such that the curve of the tooth roots can nonetheless continuously, particularly preferably at least piecewise twice continuously, be differentiated.

The at least two, preferably exactly two, meshing toothings of the toothed wheel running carriage preferably each exhibit a contour of the profile of the teeth such that the flanks of the teeth of the toothed wheels rolling off on each other form cells which are sealed off from each other. If the toothed wheel running carriage is a running carriage with an internal axle and all the fluid cells are formed only by the toothings, as is preferably the case when the difference in the number of teeth on the toothings is one, then the tooth tips of the toothings are shaped such that a radially tight gap remains at the point of minimum toothed mesh. In the case of toothed wheel running carriages, with an internal axle, in which the difference in the number of teeth is greater than one, this also applies in principle when using a sickle. Preferably, a minimum clearance exists, such that on the one hand production tolerances are compensated for, but on the other hand loses arising from the gap, in the area of minimum toothed mesh or between the tooth tips and a sickle, are minimised. In the area of maximum toothed mesh, in which a tip of a tooth of one toothing maximally meshes with a root of a tooth of the other toothing, a hollow space serving as a squeeze space for the working fluid of the toothed wheel machine is formed in accordance with the invention.

The criteria cited above are preferably fulfilled by templating the toothing of one toothed wheel in accordance with the invention as a master toothing and forming the companion toothing on the basis of this template, such that the sealed fluid cells and the pitch flanks are formed. The pitch flanks of the companion toothing in particular, providing they are a part of the curve of the tooth roots, are formed by kinematically deriving them in accordance with the law of toothings. In a preferred embodiment in which the tooth roots of the toothing in accordance with the invention are circular arcs, the hollow space or squeeze space automatically arises at the point of maximum toothed mesh of the toothings.

The hollow space can also be formed by a recess of each of the tooth roots of the toothed wheel with the toothing in accordance with the invention. Instead, or in combination with such recesses in the toothing in accordance with the invention, the toothed wheel having the companion toothing can comprise a recess in each of its tooth roots, for forming the hollow space. The toothing in accordance with the invention can comprise a discontinuity in the differentiation at each of the recesses or can also be continuously differentiated at the transitions of the curved arcs in accordance with the invention, in and out of the respective recess. Preferably, however, the toothing in accordance with the invention does not comprise such recesses, such that its contour of the profile of the teeth is formed by a smooth, continuous curved arc of a curve in accordance with the invention, not only on the tooth tips but also in the tooth roots.

The companion toothing can advantageously be obtained by interpolating spline functions on supporting points. The supporting points of the curve of the tooth roots are preferably ascertained by kinematically deriving the toothing in accordance with the invention, in accordance with the law of toothings, and the supporting points of the curve of the tooth tips are preferably ascertained from enveloping intersections of the curve of the tooth tips of the master toothing. If the tips of the master toothing are levelled off with respect to their generating curve the unflattened generating curve is used in the enveloping intersection method. Hence, if the generating curve is an arc of an ellipse, then the arc of the ellipse is used. An at least third grade, preferably exactly third grade interpolating spline function is preferred. The supporting points can in particular be formed from contact points of the rolling-off flanks of the teeth of the toothed wheels. The spline functions, in a number corresponding to the pitch of the companion toothing, are applied to meet, adapted at the transition points as appropriate, such that at least transitions which can be continuously differentiated are obtained. In this respect, the companion toothing itself represents a toothing in accordance with the invention, since its tooth profile is formed by a function which can be differentiated at least piecewise twice continuously. The spline functions preferably meet in or very near to the crown points of the tooth roots, where rolling off does not take place.

In a particularly preferred embodiment, only the profile of the tooth tips of the companion toothing is formed by a spline function, the supporting points of which are the enveloping intersection points, while the profile of the tooth roots of the companion toothing is a progression which connects the points of the profile of the tooth roots obtained from the law of toothings. The points of the profile of the tooth roots can easily be ascertained from the law of toothings sufficiently close alongside each other that a simple or linear progression is sufficient as a connecting line. For the companion toothing, this means that a spline function for a profile of the tooth tips and a progression for a profile of the tooth roots are alternately applied and meet respectively, continuously differentiable, i.e. tangentially.

A toothed wheel of the running carriage in accordance with the invention, for example the toothed wheel having the companion toothing, is preferably provided in accordance with its shaping with a so-called offset, by retracting the toothing in question a predetermined distance perpendicular to its initial contour of the profile of the teeth formed in accordance with the invention, equidistant over the entire contour. In principle, it is also possible to retract both toothed wheels, equidistant with respect to the initial contour generated in accordance with the invention. A flank backlash of the mutually mating toothings, i.e. a backlask in the circumferential direction, can be obtained solely by retracting one or both contours of the profile of the teeth, equidistant with respect to the generating rule. In such a preferred embodiment, the mutually mating toothings are formed in accordance with their respective generating rule, such that in the circumferential direction they are produced to "zero clearance". Due to the curves of the tooth tips of the companion toothing being preferably produced from enveloping intersections of the profiles of the tooth tips of the master toothing, this also applies to the required radial clearance of the toothings at minimum toothed mesh. In order to obtain the required radial clearance, i.e. the tip clearance in the area of minimum toothed mesh, the profile of the tooth tips of the companion toothing can be levelled off with respect to the profile of the tooth tips formed from enveloping intersections in accordance with the generating rule, such that this radial clearance is formed not only by equidistant retraction.

Preferred applications of a gear-type pump in accordance with the invention are, for example, those of a lube oil pump of an internal combustion engine or a lube oil pump of a transmission of a wind power generator.

Example embodiments of the invention will now be explained on the basis of figures. Features disclosed by the example embodiments, each individually and in any combination of features, advantageously develop the subjects of the claims. There is shown:

DETAILED DESCRIPTION OF THE INVENTION

Figure 1:
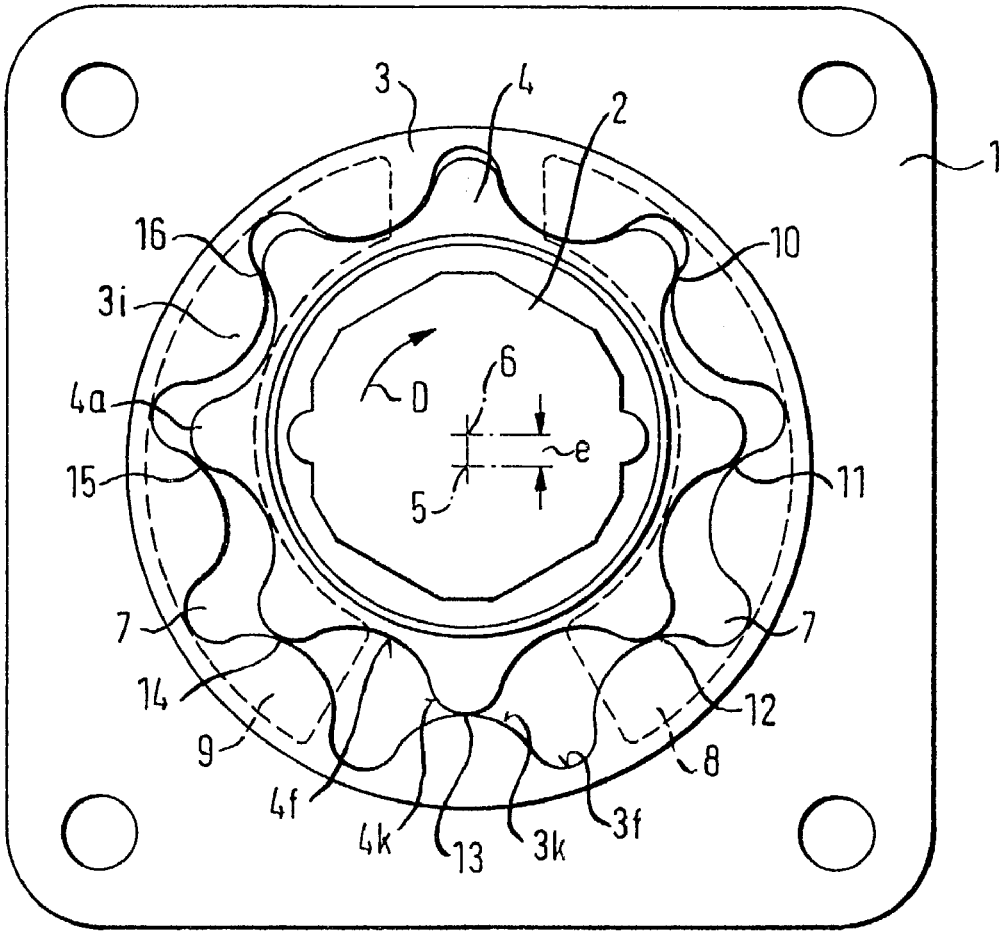
FIG. 1 a view onto a ring gear pump, in which a toothed wheel chamber with a toothed wheel running carriage can be seen.

FIG. 1 shows a ring gear pump in a vertical view onto a toothed wheel running carriage which is rotatably accommodated in a toothed wheel chamber of a pump casing 1. A cover of the pump casing has been left out, so that the toothed wheel chamber together with the toothed wheel running carriage can be seen.

The ring gear pump comprises an external rotor 3 having an internal toothing 3*i* and an internal rotor 4 having an external toothing 4*a*, which form the toothed wheel running carriage. The external toothing 4*a* has one tooth less than the internal toothing 3*i*. The number of teeth of the internal toothing of such internal-axle pumps is at least four and preferably at most fifteen; preferably, the number of teeth is between five and ten; in the example embodiment, the internal toothing 3*i* has nine teeth.

A rotational axis 5 of the external rotor 3 runs parallel to and spaced from, i.e. eccentrically with respect to, a rotational axis 6 of the internal rotor 4. The eccentricity, i.e. the distance between the two rotational axes 5 and 6, is indicated by "e".

The internal rotor 4 and the external rotor 3 form a fluid delivery space between themselves. This fluid delivery space is sub-divided into delivery cells 7 which are sealed off pressure-tight from each other. Each of the individual delivery cells 7 is formed between two consecutive teeth of the internal rotor 4 and the internal toothing 3*i* of the external rotor 3, by each two consecutive teeth of the internal rotor 4 having tip or flank contact with each two consecutive opposing teeth of the internal toothing 3*i*. A small clearance can exist between the tips 4*k* and 3*k* of the teeth, at the point of minimum tooth mesh, the delivered fluid forming a sealing film between the mutually opposing tips 4*k* and 3*k* of the teeth of the two toothings 4*a* and 3*i*.

The delivery cells 7 become increasingly larger in the rotational direction D from a point of deepest or maximum toothed mesh to the point of minimum toothed mesh, in order to then decrease again from the point of minimum toothed mesh. The increasing delivery cells 7 form a low pressure side, and the decreasing delivery cells 7 a high pressure side, when the pump is in operation. The low pressure side is connected to a pump inlet and the high pressure side is connected to a pump outlet. Closely adjacent, reniform groove openings 8 and 9 are laterally relieved in the casing 1, in the area of the delivery cells 7, and are separated from each other by stays. The opening 8 overlaps delivery cells 7 on the low pressure side and accordingly forms a supply opening, a low pressure opening when the pump is in operation, and the other opening 9 accordingly forms a high pressure opening. When operating a motor, which is equally possible using such a gear-type machine, the relationships would of course be reversed. In each of the area of the point of maximum toothed mesh and the area of the point of minimum toothed mesh, the casing forms a sealing stay between the adjacent supply and discharge openings 8 and 9.

When one of the rotors 3 and 4 is rotary driven, fluid is suctioned through the opening 8 by the expanding delivery cells 7 on the low pressure side, transported via the point of minimum toothed mesh and discharged again at high pressure through the opening 9 to the pump outlet on the high pressure side. In the example embodiment, the pump is rotary driven by a rotary drive member 2 formed by a drive shaft. The internal rotor 4 is non-rotationally connected to the rotary drive member 2. In a preferred application of the pump as a lube oil or motor oil pump for an internal combustion engine, in particular a reciprocating piston motor, the drive shaft 2 is usually formed directly by the crankshaft or the output shaft of a transmission whose input shaft is the crankshaft of the motor. It can equally be formed by a balance shaft for power or torque equilisation of the motor. Other rotary drive members are, however, likewise conceivable, in particular in other applications of the pump, for example as a hydraulic pump for a vehicle servo drive. Instead of driving the internal rotor 4, the external rotor 3 can also be rotary driven, and when it is rotationally moving can slave the internal rotor 4.

Figure 2:
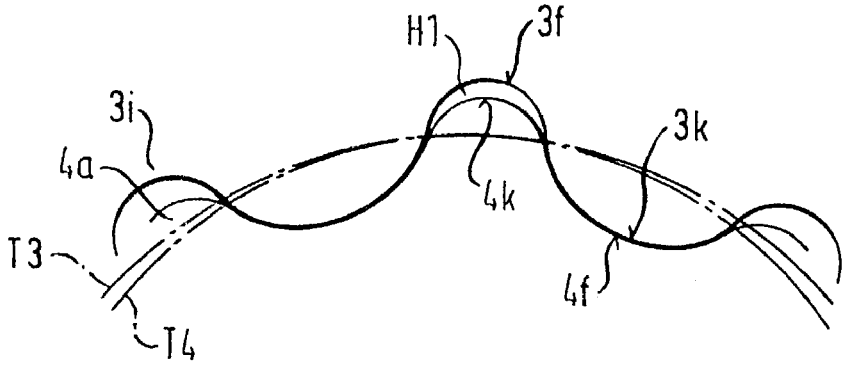
FIG. 2 a cutaway of the mutually meshing tooth profiles of the toothed wheel running carriage of FIG. 1.

FIG. 2 shows the profile contours of the toothings 3*i* and 4*a* at the point of maximum toothed mesh. The tips 3*k* of the teeth of the internal toothing 3*i* are formed as elliptical arcs and the tooth roots 3*f* of the internal toothing 3*i* are formed as circular arcs. The elliptical arcs and the circular arcs directly meet on the reference circle T3 of the internal toothing 3*i* and are adapted to each other there, such that they exhibit the same gradient at each of the joints directly formed in this way. The derivations from the left and from the right are therefore equal at the transition points of the two curved arcs, i.e. the contour of the profile of the teeth of the internal toothing 3*i* is a function which may be continuously differentiated all over, even at the transition points. The regularities for the axes of the ellipse forming the elliptical arcs are derived from the base toothing data of the modulus and the number of teeth of the external rotor 3.

In the example embodiment, the internal toothing 3*i* of the external rotor 3 is the initial toothing or master toothing. The contour of the profile of the roots 4*f* of the teeth of the internal rotor 4 is kinematically derived from the contour of the profile of the tips 3*k* of the teeth of the internal toothing 3*i*, in accordance with the law of toothings. The contour of the profile of the tooth tips 4*k* of the internal rotor 4 is obtained from enveloping intersections of the contour of the profile of the tooth tips 3*k* of the internal toothing 3*i*. The contour of the profile of the external toothing 4*a* is formed entirely by spline functions and progressions which are applied along the reference circle T4 of the external toothing 4*a*. The spline functions are obtained on support points. The law of toothings provides the support points for the progressions of the tooth roots 4*f*, and the enveloping intersection method provides the support points for the spline functions of the tooth tips 4*k*. From the snapshot in FIG. 1, for example, the support points 10-16 result for the tooth tips 4*k*. The support points 10-16 are the momentary contact points of the pitch flanks of the two toothings 3*i* and 4*a*, and in the snapshot of FIG. 1, form the sealing points between the individual fluid cells 7. If the two toothed wheels 3 and 4 are further rotated by a small angle, a next set of support points can be obtained. The larger the number of support points, or the closer the support points are alongside each other, the more exactly tooth the tips 4*k* of the external toothing 4*a* are each approximated by the same interpolating spline function.

Figure 2A:
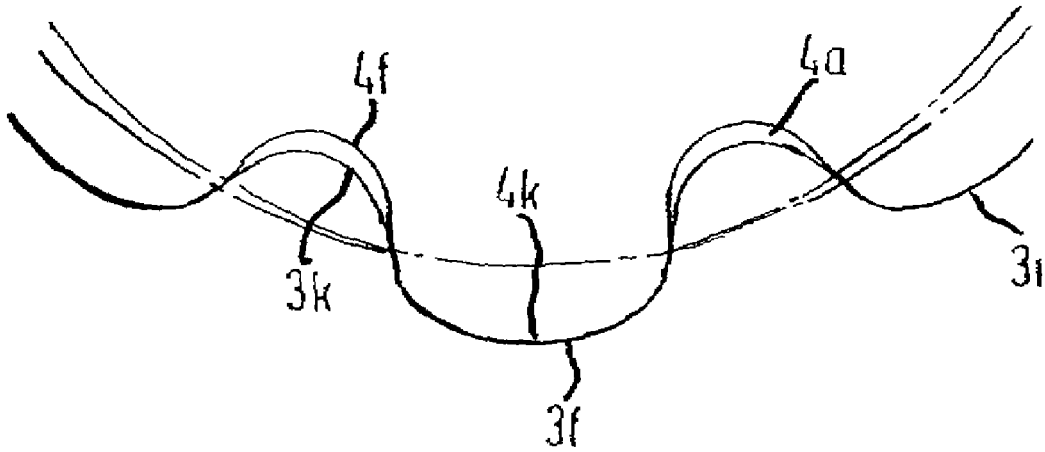
FIG. 2*a* is a cutaway similar to FIG. 2 illustrating an alternative embodiment of the invention wherein the external toothing is the master toothing.

Instead of predetermining the internal toothing 3*i* as the master toothing, the external toothing 4*a* can just as well be the master toothing and in this case the internal toothing 3*i* can be described by spline functions and progressions or also only by spline functions, namely one for the tooth tips and another for the tooth roots. If the external toothing 4*a* is the master toothing its tooth tips 4*k* and its tooth roots 4*f* are formed as described herein with respect to the tooth tips 3*k* and the tooth roots 3*f*, respectively, of the internal toothing 3*i*, illustrated in FIG. 2*a*.

FIG. 2 shows the area of maximum toothed mesh, enlarged. A hollow space H1 can clearly be seen, which arises in the area of the crown points between the tip 4*k* of the tooth of the internal rotor 4 currently maximally meshing, and of the accommodating tooth root 3*f* of the external rotor 3. The length ratio between the long and the short axis of the ellipse forming the elliptical arcs of the internal toothing 3*i* is 3:2 in the example embodiment. Length ratios up to 6:5 or even 10:9 are, however, also still advantageous. The two toothings 4*a* and 3*i* combine the noise advantages of a gerotor with the volumetric advantages of a toothed wheel running carriage such as is known from U.S. Pat. No. 5,368,455.

Figure 3:
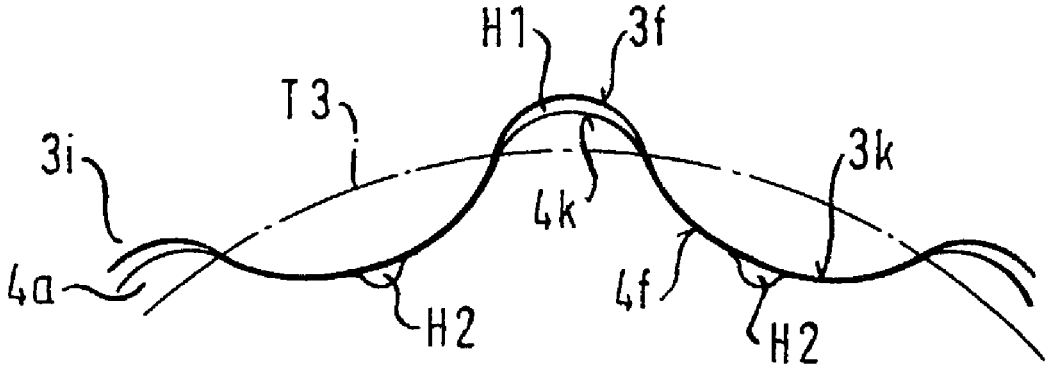
FIG. 3 a cutaway of mutually meshing tooth profiles of an embodiment variant.

FIG. 3 shows the point of maximum toothed mesh for a toothed wheel running carriage whose internal rotor 3 comprises the same internal toothing 3*i* as the internal rotor 3 of the toothed wheel running carriage of FIGS. 1 and 2. The external toothing 4*a* is also formed by the same curved arcs as the external toothing 4*a* of the first example embodiment, although recesses are formed in the tooth roots 4*f*, said recesses providing additional hollow spaces H2 for the fluid. Apart from the recesses, however, the tooth roots 4*f* of the variant in FIG. 3 are identical to the tooth roots 4*f* of the first example embodiment.

Figure 4:
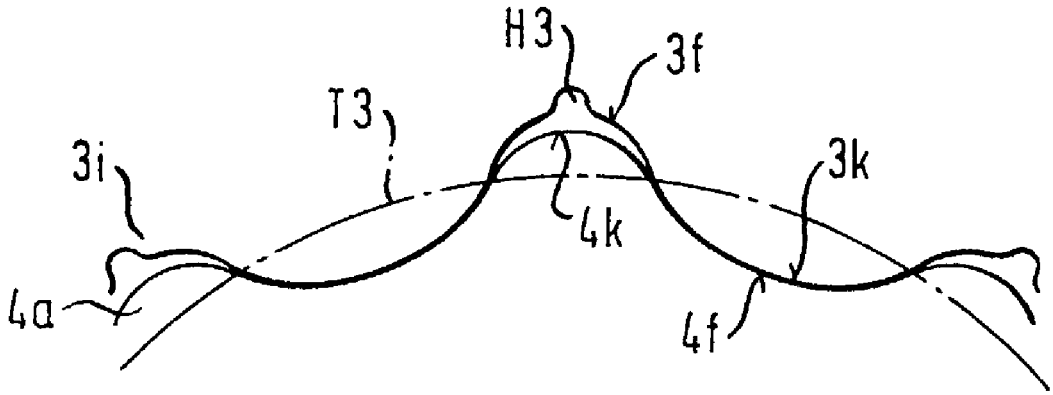
FIG. 4 a cutaway of mutually meshing tooth profiles of another embodiment variant.

In the variant in FIG. 4, the internal toothing 3*i* comprises the same tooth tips 3*k* as the internal toothing 3*i* of the first example embodiment. The tooth roots 3*f*, however, are formed by elliptical arcs. These elliptical arcs are each provided with a recess in the area of their crown point. If, because of the tooth roots 3*f* formed by elliptical arcs, a sufficient squeeze space is not already provided at the point of maximum toothed mesh solely by the difference in the number of teeth of the two toothings 3*i* and 4*a*, a hollow space H3 of a sufficient size can nonetheless be provided by each of the recesses of the tooth roots 3*f*. In principle, however, it is assumed that even without recesses, sufficient squeeze space is provided at the point of maximum toothed mesh by the toothing templated in accordance with the invention—the internal toothing 3*i* in the example embodiment—and the companion toothing formed in accordance with the invention.

For the sake of completeness, reference is also made to the fact that recesses can be realised in each of the two toothings 3*i* and 4*a* in a single toothed wheel running carriage.

FIGS. 5 to 8 are intended to illustrate in more detail a preferred production precept for the two toothings 3*i* and 4*a*, to be understood however only as an example.

Figure 5:
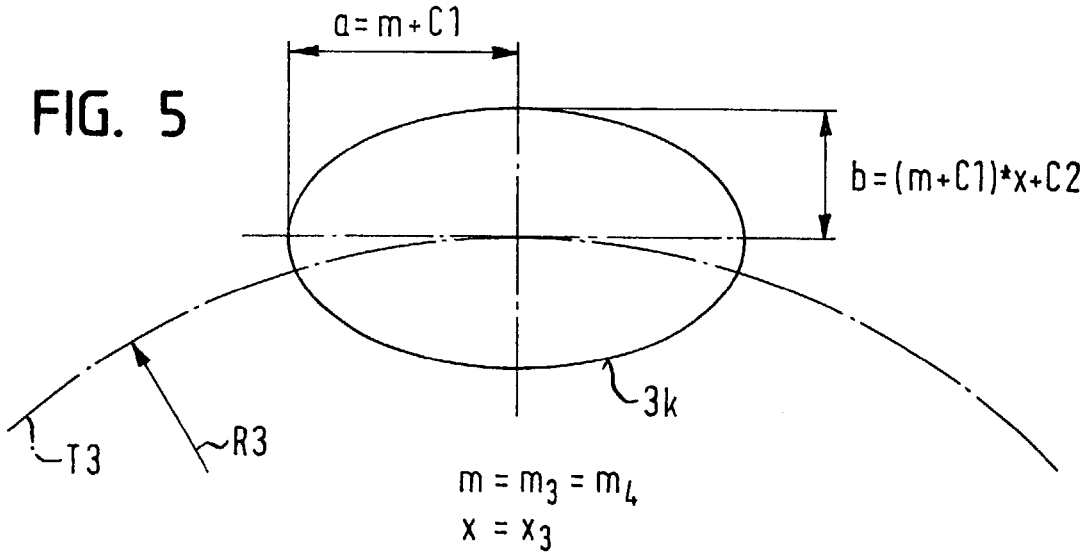
FIG. 5 a profile of the tooth tips of a master toothing, the profile being formed by an elliptical arc.
Figure 6:
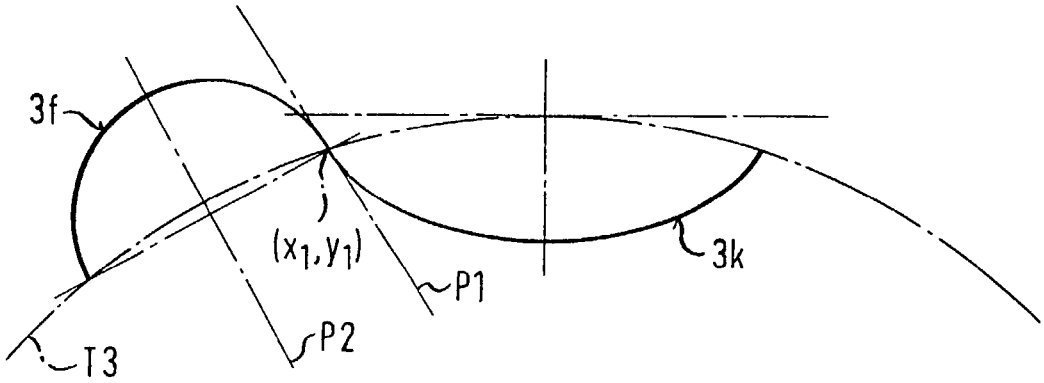
FIG. 6 the elliptical profile of the tooth tips of FIG. 5 and a profile of the tooth roots, connected to said tip profile and formed by a circular arc.

FIG. 5 shows the contour of the profile of an individual tip 3*k* of a tooth of the master toothing 3*i*. FIG. 6 shows the same tooth tip 3*k* and a tooth root 3*f* which tangentially approaches the tooth tip 3*k* on the reference circle T3 of the master toothing 3*i*. The tangent in common in the intersecting point with the reference circle T3 is indicated by P1. The radial of the reference circle T3 through the centre point of the circle forming the contour of the profile of the tooth root 3*f* is indicated by P2.

The eliptical arc of the tooth tip 3*k* is taken, as shown in FIG. 5, from an ellipse comprising a large semi-axis a and a small semi-axis b. The small semi-axis b is a radial of the reference circle T3. The large semi-axis a is a tangent to the reference circle T3. The arc of the ellipse, within the reference circle T3, forms the contour of the profile of the tooth tip 3*k*. It terminates on the reference circle T3.

The base toothing data of the master toothing 3*i* are:

modulus $m_3$ number of teeth $z_3$ profile shift $x_3$

The modulus and the number of teeth define the diameter of the reference circle T3 as $$d_3=m_3*z_3.$$

The profile shift defines the ratio of tooth tip to tooth root and in particular the curvature of the elliptical arc forming the tips 3*k* of the teeth. The sum of the profile shift of the external toothing and the internal toothing is equal to 1:

$$\Sigma(x_3;\ x_4)=1$$

The generating rule for the ellipse is:

$$a=m_3+C1$$

$$b=(m_3+C1)*x_3+C2.$$

The tip circle of the master toothing 3*i* is thus calculated as:

$$dk_3=d_3-2*((m_3+C1)*x_3+C2).$$

The constants C1 and C2 can be used either to produce the gap between the master toothing 3*i* and the companion toothing 4*a* or to set the curvature of the ellipse or for both purposes simultaneously. If it is used to produce the gap, it is advantageous to change each of the semi-axes a and b by the same amount, in order to widen the gap as uniformly as possible along the elliptical arc.

If one takes the radial P2 as the y-axis of a Cartesian system of coordinates with the centre point of the reference circle T3 as the coordinate origin, then the root circle of the master toothing is calculated as:

$$df_3=2*(x1+y1),$$

wherein x1 and y1 are the coordinates of the intersecting point of the tangent P1 with the reference circle T3 (FIG. 6).

Figure 7:
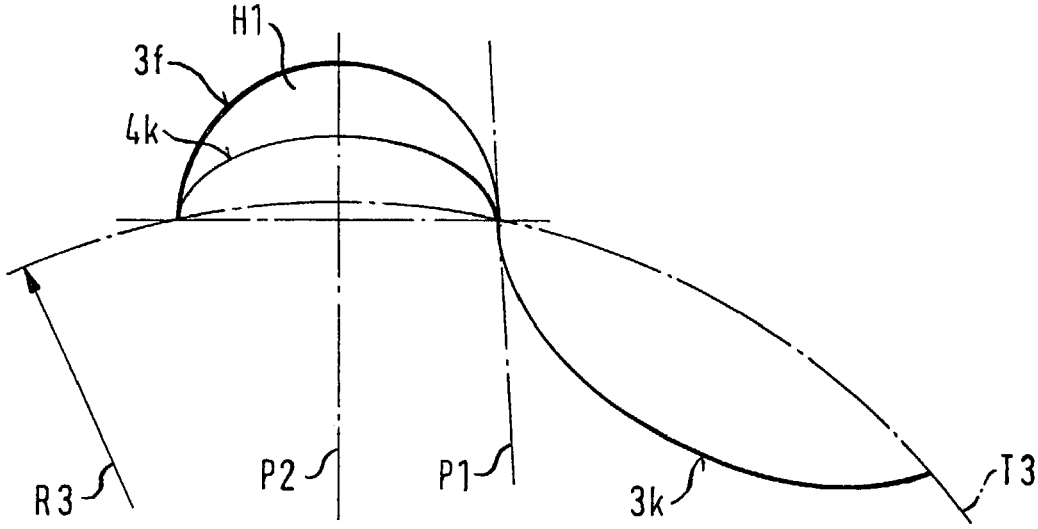
FIG. 7 the profile of FIG. 6 and a profile of the tooth tips of a companion toothing.

FIG. 7 shows the contour of the profile of FIG. 6 together with the contour of the profile of a tooth tip 4*k* of the companion toothing 4*a* in the area of maximum toothed mesh, where the hollow space H1 for squeeze fluid remains between the contour of the profile of the tooth root 3*f* and the contour of the profile of the tooth tip 4*k*. The contour of the profile of the adjacent tooth root of the companion toothing 4*a* is not shown. It is derived from the elliptical arc of the tooth tip 3*k* of the master toothing 3*i*, in accordance with the law of toothings.

Figure 8:
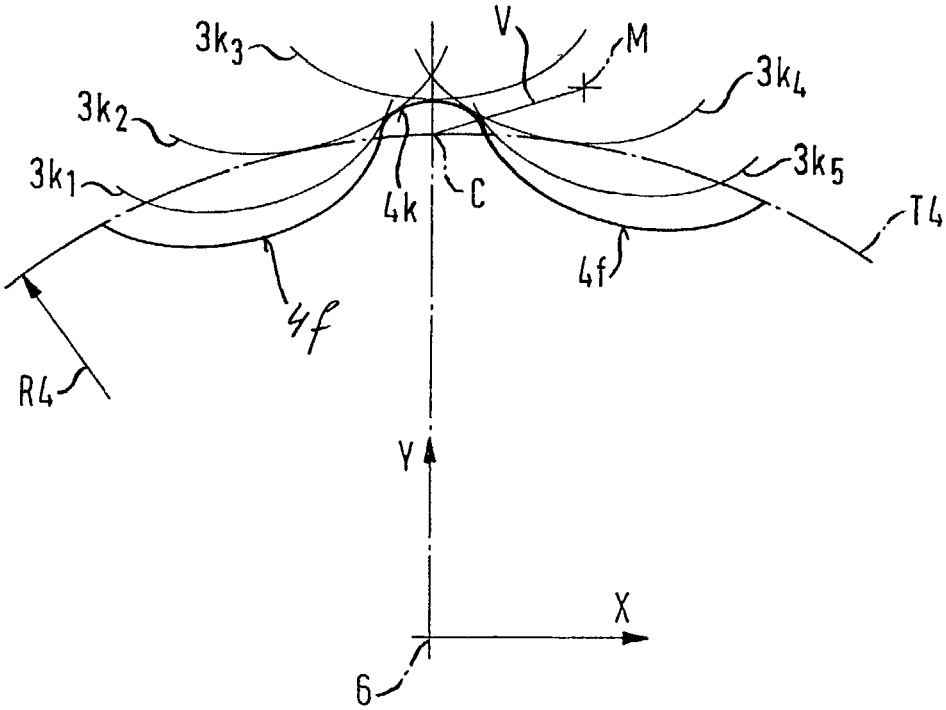
FIG. 8 generating the profile of the tooth tips of the companion toothing from enveloping intersections.

The enveloping intersection method for producing the contour of the profile of the tooth tips 4*k* of the companion toothing 4*a* is illustrated in FIG. 8. In the plane of the reference circle T4, the contour of the profile of the tooth tips 4*k* is the connecting line which connects the enveloping intersection points of the curves of the tooth tips 3*k*, i.e. the elliptical arcs, of the master toothing 3*i* to each other. Each of the points is the intersecting point of one of the curves of the tooth tips 3*k* with a straight line V which connects the centre point M of the respective ellipse and the intersecting point C of the radial with the reference circle T4. The corresponding radial through the intersecting point C exhibits on the reference circle T4 the same distance from the adjacent tooth roots 4*f* on both sides. The intersecting point of the elliptical axes a and b is understood as the centre point M of the ellipse. By rotating a sufficiently large number of the elliptical arcs forming the tooth tips 3*k* onto the same intersecting point C (the pitch point), a sufficiently large number of enveloping intersection points, i.e. contact points, can be obtained, said points serving as support points of the profile contour of the tooth tips 4*k* to be produced.

The enveloping intersection points are obtained by rotating curves of tooth tips of the master toothing 3*i* about the pitch circle axis 6 of the companion toothing 4*a*, wherein the curves of the tooth tips 3*k* of the master toothing 3*i* are each rotated onto the same tooth of the companion toothing 4*a*. To this end, the toothed wheel running carriage should be imagined in the pitch circle plane. The master toothing 3*i* is known. Furthermore, the position of the pitch circle axis 6 of the companion toothing 4*a* relative to the master toothing 3*i* is known. Furthermore, the number of teeth of the companion toothing 4*a* is known, such that a star of radials, proceeding from the pitch circle axis 6 of the companion toothing 4*a* to the crown points of the tooth tips 4*k* to be produced, can be positioned relative to the master toothing 3*i*. The curves of the tooth tips 3*k* of the master toothing 3*i* are then rotated about the pitch circle axis 6 of the companion toothing 4*a*, into one of the radials. In this way, for a particular position assumed by the two toothings 3*i* and 4*a* relative to each other, a set of curves of tooth tips of the master toothing 3*i* is obtained which envelope the curve of the tooth tip 4*k* to be produced, for example the curves of the tooth tips $3k_1$ to $3k_5$ in FIG. 8. The curves of the tooth tips $3k_1$ to $3k_5$ can be the curves of the tooth tips having the contact points 11 to 15 from the snapshot in FIG. 1. This procedure is repeated for different relative positions of the two toothings 3*i* and 4*a*, the pitch circle axes 5 and 6 of course retaining their positions. For each of the snapshots, the master toothing 3*i* is rotated about the pitch circle axis 6 of the companion toothing 4*a*, such that the respective radials of the companion toothing 4*a* are always overlapped by the same radial once established.

For the sake of completeness, the reference circle diameter and the tip circle diameter of the companion toothing 4*a* should also be given. For the diameter $d_4$ of the reference circle T4, it holds that:

$$d_4=m_4*z_4,$$

wherein the modulus is $m_4=m_3$ and the number of teeth is $z_4=z_3-1$. The tip circle diameter $dk_4$ emerges as:

$$dk_4=d_4+2*((m_4-C1)*x_4-C2).$$

Since the relationship:

$$e+dk_4/2<df_3$$

holds, the hollow spaces H1 arise between the tooth roots 3*f* of the master toothing 3*i* and the tooth tips 4*k* of the companion toothing 4*a*. Space for squeeze fluid thus arises from the generating rule alone, which helps to reduce noise.

Figure 9:
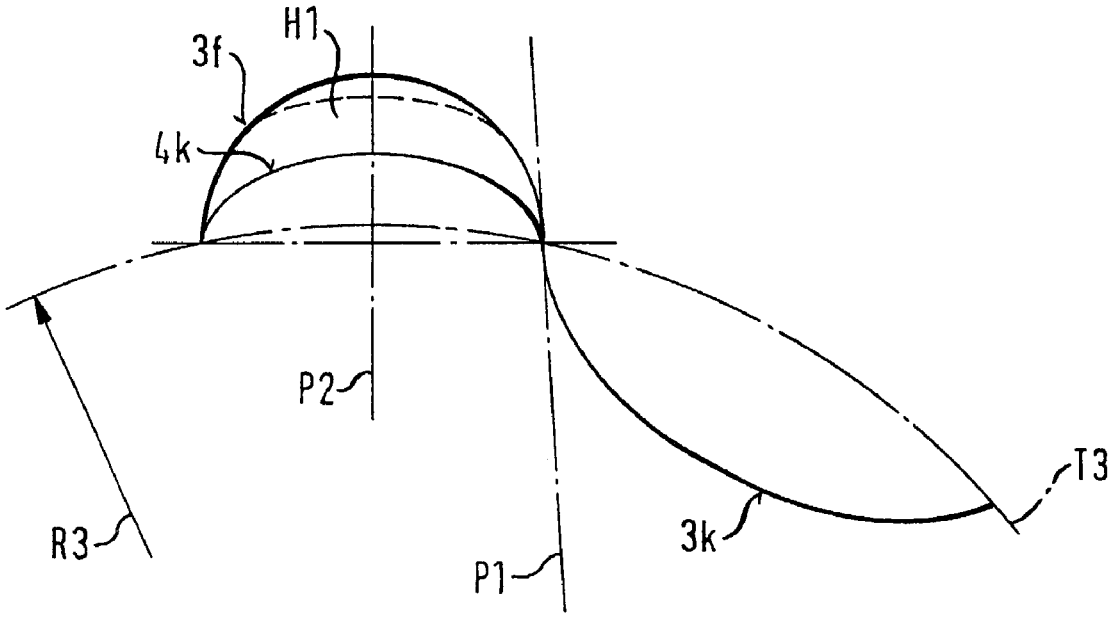
FIG. 9 a modification of the profile of the tooth tips of FIGS. 5 and 6.

FIG. 9 shows by way of example how the hollow space H1 can be reduced by levelling off the curve of the tooth root 3*f* of the master toothing 3*i*, in order to reduce the dead volume. To this end, the profile contour of the tooth roots 3*f* in the example is levelled off in the crown area as compared to the circular arc selected in accordance with the elliptical arc of the tooth tips 3*k*. The levelling off is shown by a broken line.

The invention claimed is:

1. A toothing of a toothed wheel forming an internal or external rotor of a ring gear machine, the toothing of said toothed wheel comprising tooth tips and tooth roots, the tooth tips and tooth roots are formed from second or higher order curves which point tangentially toward each other at their ends, wherein the curves forming the tooth tips and the curves forming the tooth roots are not cycloids, and wherein the tooth tips of said toothed wheel are each formed by an arc of an ellipse or a Cassini curve in its ellipse-like form and wherein the tooth roots of said toothed wheel are each formed by an arc of a circle.

2. The toothing of a toothed wheel as set forth in claim 1, wherein a contour of the profile of the teeth, formed by the curves, is continuously differentiated.

3. The toothing of a toothed wheel as set forth in claim 2, wherein the contour is differentiated at least piecewise twice continuously.

4. The toothing of a toothed wheel as set forth in claim 1, wherein the toothing comprises recesses in the tooth roots, and the curves form a tooth profile contour at least up to the recesses, wherein said contour is continuously differentiated.

5. The toothing of a toothed wheel as set forth in claim 4, wherein said contour is differentiated at least piecewise twice continuously.

6. A toothing of a toothed wheel forming an internal or external rotor of a ring gear machine, the toothing of said toothed wheel comprising tooth tips and tooth roots, the tooth tips and the tooth roots are formed by second or higher order curves, wherein said curves point tangentially toward each other at their ends, wherein at least the curves of the flanks of the tooth tips of said toothed wheel are each formed by an arc of an ellipse or a Cassini curve in its ellipse-like form, and wherein the curves of the flanks of the toothed roots of said toothed wheel are each formed by an arc of a circle.

7. The toothing of a toothed wheel as set forth claim 6, wherein said arc forming each of the curves of the flanks of the tooth tips form the tooth tips each as a whole.

8. The toothing of a toothed wheel as set forth in claim 6, wherein the curves of the flanks of the toothed roots each formed by an arc of a circle form the tooth roots each as a whole.

9. A toothed wheel running carriage for or in a toothed wheel machine (pump or motor), said toothed wheel running carriage comprising:

a) a first toothed wheel having a first toothing consisting of tooth tips and tooth roots which are formed by second or higher order curves, wherein said curves point tangentially toward each other at their ends, and wherein at least the curves forming the tooth tips or at least the curves forming the tooth roots are not cycloids;

b) and at least a second wheel having a second toothing which is in toothed mesh with said first toothing;

c) wherein at least one of the toothings comprises tooth roots which are shaped such that, in a maximum toothed mesh of a tooth tip of the other of the toothings, they each form a hollow space;

d) wherein the profile contour of the tooth tips of the second toothing is obtained from envelope intersections of the profile contour of the tooth tips of the first toothing.

10. The toothed wheel running carriage as set forth in claim 9, wherein the second toothing comprises tooth roots for rolling off of the toothings, said tooth roots being formed by kinematically deriving from the first toothing in accordance with the law of toothings.

11. The toothed wheel running carriage as set forth in claim 9, wherein the profile contour of the tooth tips and/or of the tooth roots of the second toothing is formed by at least third grade spline functions.

12. The toothing wheel running carriage as set forth in claim 11, wherein said contour is formed by exactly third grade spline functions.

13. The toothed wheel running carriage as set forth in claim 9, wherein the second toothing comprises a recess in each of its tooth roots, for forming the hollow space.

14. The toothed wheel running carriage as set forth in claim 9, wherein the tooth tips of the first toothing are formed by conic section arcs and the tooth roots of the first toothing are shaped such that, in said maximum toothed mesh of a tooth tip of the second toothing, they each form the hollow space.

15. The toothed wheel running carriage as set forth in claim 9, wherein the first toothed wheel is an external rotor or stator, the first toothing is an internal toothing, the second toothed wheel is an internal rotor and the second toothing is an external toothing of the internal axle toothed wheel running carriage.

16. A toothed wheel running carriage for or in a toothed wheel machine (pump or motor), said toothed wheel running carriage comprising:

a) a first toothed wheel having a first toothing consisting of tooth tips and tooth roots which are formed by second or higher order curves, wherein said curves point tangentially toward each other at their ends, and wherein at least the curves forming the tooth tips or at least the curves forming the tooth roots are not cycloids;

b) and at least a second wheel having a second toothing which is in toothed mesh with said first toothing;

c) wherein at least one of the toothings comprises tooth roots which are shaped such that, in a maximum toothed mesh of a tooth tip of the other of the toothings, they each form a hollow space;

d) wherein the profile contour of at least one of the tooth tips and the tooth roots of the second toothing is formed by at least third grade spline functions.

17. The toothed wheel running carriage as set forth in claim 16, wherein the second toothing comprises tooth roots for rolling off of the toothings, said tooth roots being formed by kinematically deriving from the first toothing in accordance with the law of toothings.

18. The toothed wheel running carriage as set forth in claim 16, wherein the profile contour of the tooth tips of the second toothing is obtained from envelope intersections of the profile contour of the tooth tips of the first toothing.

19. The toothing wheel running carriage as set forth in claim 16, wherein said contour is formed by exactly third grade spline functions.

20. The toothed wheel running carriage as set forth in claim 16, wherein the second toothing comprises a recess in each of its tooth roots, for forming the hollow space.

21. The toothed wheel running carriage as set forth in claim 16, wherein the tooth tips of the first toothing are formed by conic section arcs and the tooth roots of the first toothing are shaped such that, in said maximum toothed mesh of a tooth tip of the second toothing, they each form the hollow space.

22. The toothed wheel running carriage as set forth in claim 16, wherein the first toothed wheel is an external rotor or stator, the first toothing is an internal toothing, the second toothed wheel is an internal rotor and the second toothing is an external toothing of the internal axle toothed wheel running carriage.

23. A toothed wheel running carriage for or in a toothed wheel machine (pump or motor), said toothed wheel running carriage comprising:

a) a first toothed wheel having a first toothing consisting of tooth tips and tooth roots which are formed by second or higher order curves, wherein said curves point tangentially toward each other at their ends, and wherein at least the curves forming the flanks of the tooth tips are arcs of an ellipse or a Cassini curve in its ellipse-like form;

b) and at least a second wheel having a second toothing which is in toothed mesh with said first toothing;

c) wherein at least one of the toothings comprises tooth roots which are shaped such that, in a maximum toothed mesh of a tooth tip of the other of the toothings, they each form a hollow space;

d) wherein the profile contour of at least one of the tooth tips and the tooth roots of the second toothing is formed by at least third grade spline functions.

24. The toothed wheel running carriage as set forth in claim 23, wherein the second toothing comprises tooth roots for rolling off of the toothings, said tooth roots being formed by kinematically deriving from the first toothing in accordance with the law of toothings.

25. The toothed wheel running carriage as set forth in claim 23, wherein the profile contour of the tooth tips of the second toothing is obtained from envelope intersections of the profile contour of the tooth tips of the first toothing.

26. The toothing wheel running carriage as set forth in claim 23, wherein said contour is formed by exactly third grade spline functions.

27. The toothed wheel running carriage as set forth in claim 23, wherein the second toothing comprises a recess in each of its tooth roots, for forming the hollow space.

28. The toothed wheel running carriage as set forth in claim 23, wherein the tooth tips of the first toothing are formed by conic section arcs and the tooth roots of the first toothing are shaped such that, in said maximum toothed mesh of a tooth tip of the second toothing, they each form the hollow space.

29. The toothed wheel running carriage as set forth in claim 23, wherein the first toothed wheel is an external rotor or stator, the first toothing is an internal toothing, the second toothed wheel is an internal rotor and the second toothing is an external toothing of the internal axle toothed wheel running carriage.

30. A toothed wheel running carriage for or in a toothed wheel machine (pump or motor), said toothed wheel running carriage comprising:

a) a first toothed wheel having a first toothing consisting of tooth tips and tooth roots which are formed by second or higher order curves, wherein said curves point tangentially toward each other at their ends, and wherein at least the curves forming the flanks of the tooth tips are arcs of an ellipse or a Cassini curve in its ellipse-like form;

b) and at least a second wheel having a second toothing which is in toothed mesh with said first toothing;

c) wherein at least one of the toothings comprises tooth roots which are shaped such that, in a maximum toothed mesh of a tooth tip of the other of the toothings, they each form a hollow space;

d) wherein the profile contour of the tooth tips of the second toothing is obtained from envelope intersections of the profile contour of the tooth tips of the first toothing.

31. The toothed wheel running carriage as set forth in claim 30, wherein the second toothing comprises tooth roots for rolling off of the toothings, said tooth roots being formed by kinematically deriving from the first toothing in accordance with the law of toothings.

32. The toothed wheel running carriage as set forth in claim 30, wherein the profile contour of the tooth tips and/or of the tooth roots of the second toothing is formed by at least third grade spline functions.

33. The toothing wheel running carriage as set forth in claim 32, wherein said contour is formed by exactly third grade spline functions.

34. The toothed wheel running carriage as set forth in claim 30, wherein the second toothing comprises a recess in each of its tooth roots, for forming the hollow space.

35. The toothed wheel running carriage as set forth in claim 30, wherein the tooth tips of the first toothing are formed by conic section arcs and the tooth roots of the first toothing are shaped such that, in said maximum toothed mesh of a tooth tip of the second toothing, they each form the hollow space.

36. The toothed wheel running carriage as set forth in claim 30, wherein the first toothed wheel is an external rotor or stator, the first toothing is an internal toothing, the second toothed wheel is an internal rotor and the second toothing is an external toothing of the internal axle toothed wheel running carriage.

* * * * *